United States Patent [19]

Hadama

[11] 4,087,213

[45] May 2, 1978

[54] SELF-ALIGNING RECIPROCATING PLUNGER PUMP

[75] Inventor: Shigeyuki Hadama, Atsugi, Japan

[73] Assignee: Atsugi Motor Parts, Co., Ltd., Atsugi, Japan

[21] Appl. No.: 738,956

[22] Filed: Nov. 4, 1976

[30] Foreign Application Priority Data

Jul. 21, 1976 Japan ..... 51-85926

[51] Int. Cl.[2] ..... F04B 21/02

[52] U.S. Cl. ..... 417/454; 139/435; 417/568; 417/539

[58] Field of Search ..... 417/539, 454, 568, 540; 92/129; 139/435

[56] References Cited

U.S. PATENT DOCUMENTS

| | | | |
|---|---|---|---|
| 952,440 | 3/1910 | Dalzell | 417/454 |
| 1,003,848 | 9/1911 | Wood | 417/539 |
| 1,489,528 | 4/1924 | Hesselman | 92/129 |
| 1,605,530 | 11/1926 | Garber | 417/454 |
| 2,474,512 | 6/1949 | Bechtold et al. | 417/540 |
| 2,554,002 | 5/1951 | Bramesderfer et al. | 417/568 |
| 3,372,647 | 3/1968 | Kling | 417/568 |
| 3,880,054 | 4/1975 | Domyan | 92/129 |
| 3,977,442 | 8/1976 | Shibata et al. | 139/435 |

FOREIGN PATENT DOCUMENTS

| | | | |
|---|---|---|---|
| 1,212,918 | 10/1959 | France | 417/568 |
| 1,018,441 | 1/1953 | France | 417/568 |
| 717,709 | 2/1942 | Germany | 417/539 |

*Primary Examiner*—William L. Freeh

*Attorney, Agent, or Firm*—Stevens, Davis, Miller & Mosher

[57] ABSTRACT

A self-aligning reciprocating plunger pump particularly suitable for use in a water jet loom which makes use of a water jet for the purpose of picking a weft into warp openings. The pump is provided in its casing with a push rod slidably mounted in a guide hole formed in the casing and driven by a cam. The push rod is abutted through a spherical surface member provided on a plunger slidably mounted in a cylinder against the plunger.

A main valve box connected to a discharge opening provided in a cover casing is arranged adjacent to a control valve box connected to a water jet device which is fastened to the main valve box by bolts.

1 Claim, 7 Drawing Figures

SELF-ALIGNING RECIPROCATING PLUNGER PUMP

This invention relates to a self-aligning reciprocating plunger pump particularly suitable for use in a water jet loom which makes use of a water jet for the purpose of picking a weft into warp openings.

In reciprocating plunger pumps, more particularly, the kind of pump for reciprocating a plunger in a cylinder by rotating a cam, it is impossible to avoid a side pressure that tends to urge the plunger against the side wall of the cylinder and hence induce a power loss. As a result, a reciprocating plunger pump for a water jet loom, which requires the utilization of a water jet under a high pressure of the order of several tens $Kg/cm^2$ for picking a weft into warp openings, must be provided with both a pump and a motor which are significantly large in size.

An object of the invention, therefore, to provide a self-aligning reciprocating plunger pump which is so constructed that thrust subjected to a plunger by a rotating a cam is exerted in a direction along an axis of a cylinder thus providing a pump and a motor which are simple in construction and small in size, yet producing a desired output.

Another object of the invention is to provide a self-aligning reciprocating plunger pump which is so constructed that a plunger in a cylinder is self-aligned with an axis of the cylinder, which has mostly been fastened by bolts to a casing cover to be connected to a pump without taking any special care for centering the plunger with the axis of the cylinder, thereby reliably facilitating assembling and disassembling the pump and the detachable mounting of the casing cover.

A further object of the invention is to provide a self-aligning reciprocating plunger pump which is so constructed that a pump is made simple in construction such that a water jet control device connected to an outlet of the pump is made integral with the pump whereby a high pressure water jet source is made small in size and convenient in handling.

The invention will now be described in greater detail with reference to the accompanying drawings, wherein.

Figure 1:
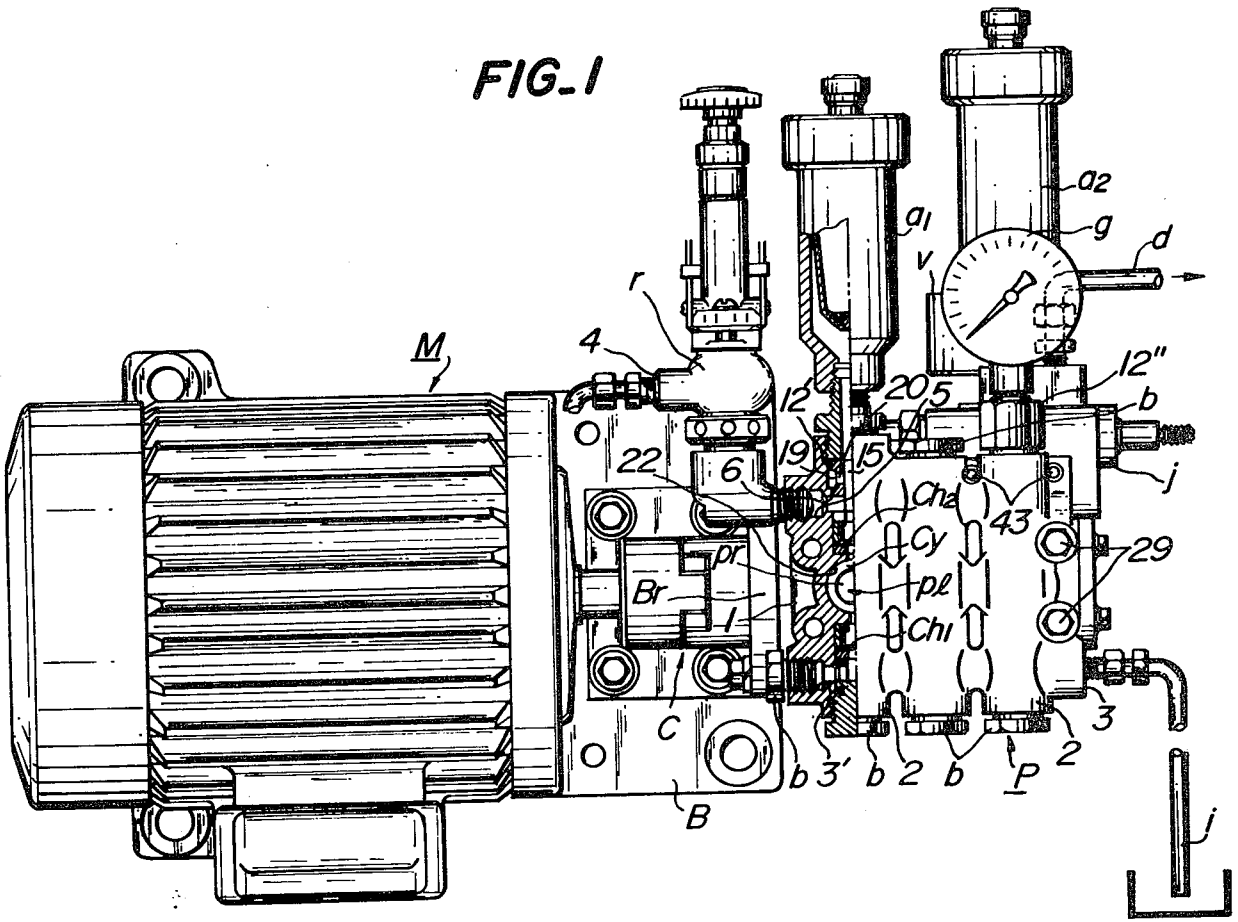
FIG. 1 is a front elevational view showing an embodiment of the invention, partly in section, applied to a water jet device for a water jet loom which makes use of a water jet for the purpose of picking a weft into warp openings.

Referring now to FIG. 1, a pump P is a reciprocating plunger pump composed of three sets of cylinders C*y* in each of which is slidably mounted a plunger P*l*. As shown in FIG. 3, the plunger P*l* is driven by a cam C*a* which is secured to a cam shaft S (FIG. 2) coupled through a coupling C to a motor M.

In FIGS. 1 to 4, *i* designates a suction pipe, *m* a connection pipe, *d* a water jet pipe, *r* a pressure regulator, $a_1$, $a_2$ accumulators, *g* a pressure gauge, *v* a main valve, *j* a control valve, *b* a blind plug and *n* a water jet nozzle.

Figure 4:
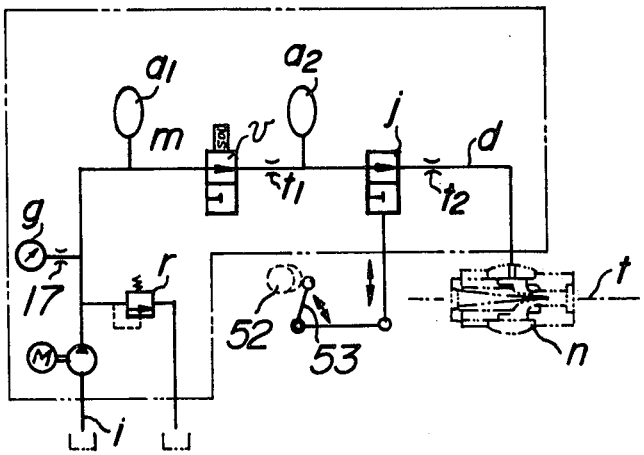
FIG. 4 is a simplified illustration of a water jet circuit that may be practice the present invention.

If the pump P is operated, water is sucked into the suction pipe *i* and then fed through a check valve $Ch_1$ into a pump chamber P*r*. The water in the pump chamber P*r* is pressurized by the plunger P*l* to forcedly open a check valve $Ch_2$ and fed under pressure into a discharge chamber. Discharging pressure is adjusted by the pressure regulator *r* and the water pressure thus regulated is indicated by the pressure gauge *g*. The pressurized water is then fed to the accumulator $a_1$ and through the connection pipe *m* (FIG. 2) to the main valve *v* and then to the control valve *j* from which is fed to the water jet nozzle *n* (FIG. 4). The water jet nozzle *n* serves to jet the pressurized water together with a weft *t* to warp openings (not shown). As shown in FIG. 4, between the main valve *v* and the second accumulator $a_2$ is inserted a throttle $t_1$ and between the control valve *j* and the water jet nozzle *n* is inserted a throttle $t_2$. These throttles $t_1$, $t_2$ serve to improve the pressure characteristic of the jet water emitted from the water jet nozzle *n* and for picking the weft *t* to the warp openings.

Figure 2:
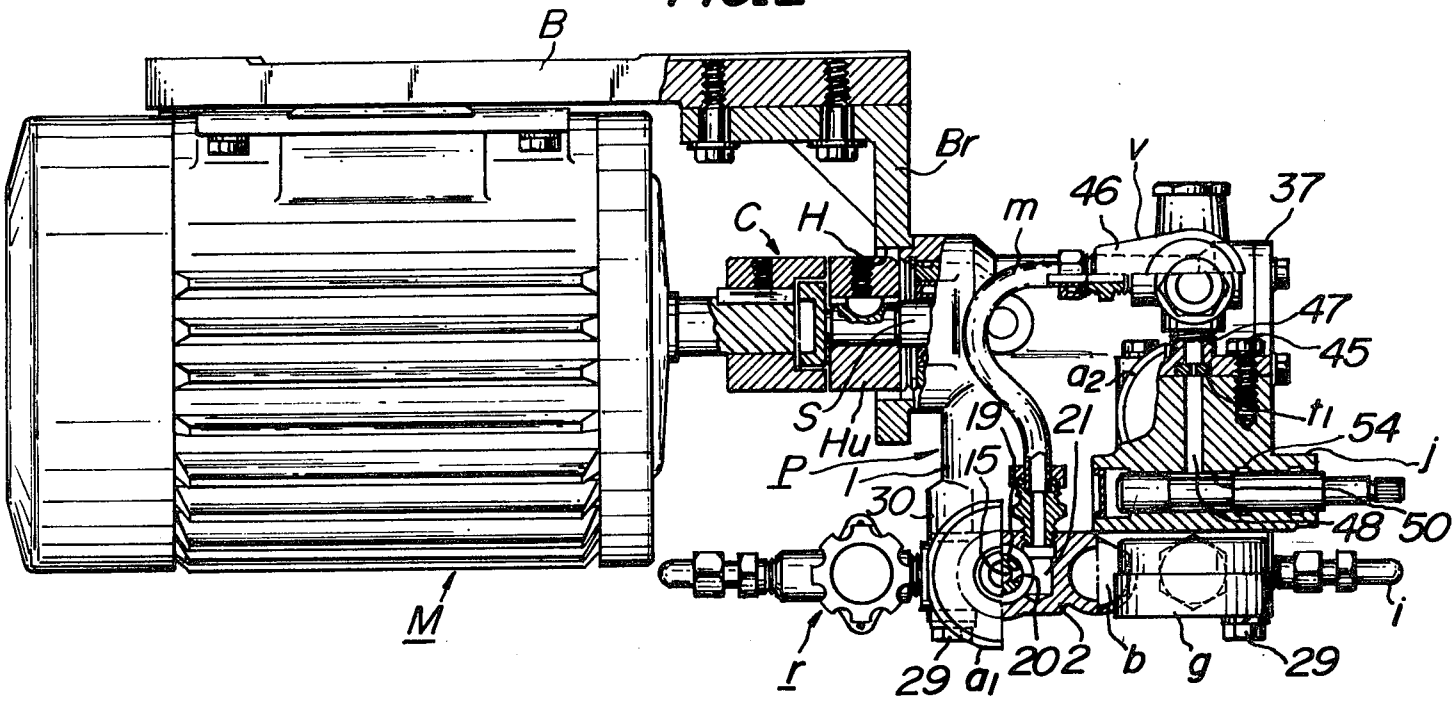
FIG. 2 is its plan view partly in section.
Figure 3:
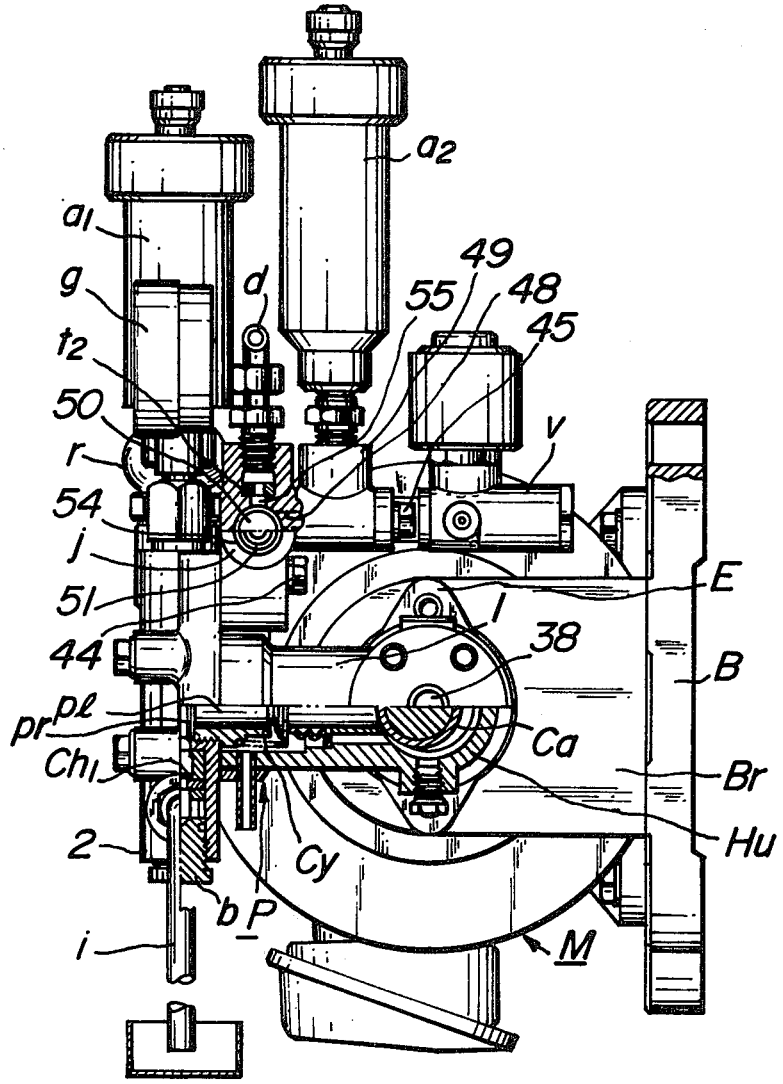
FIG. 3 is an end view partly in section of FIG. 1.

As shown in FIGS. 1 to 3, the motor M is mounted on a base plate B which is provided at the front surface of one end thereof with a bracket B*r* (FIG. 2) fastened by bolts to the base plate B. The bracket B*r* is provided at one of arms thereof with a hole H into which is fitted one end of a cam housing H*u*. The cam housing H*u* is provided with a cam shaft S. The cam shaft S is projected from the cam housing H*u* and connected through a coupling C to the output shaft of the motor M. The pump P is fastened to an end flange E (FIG. 3) and the bracket B*r* by bolts.

Figure 5:
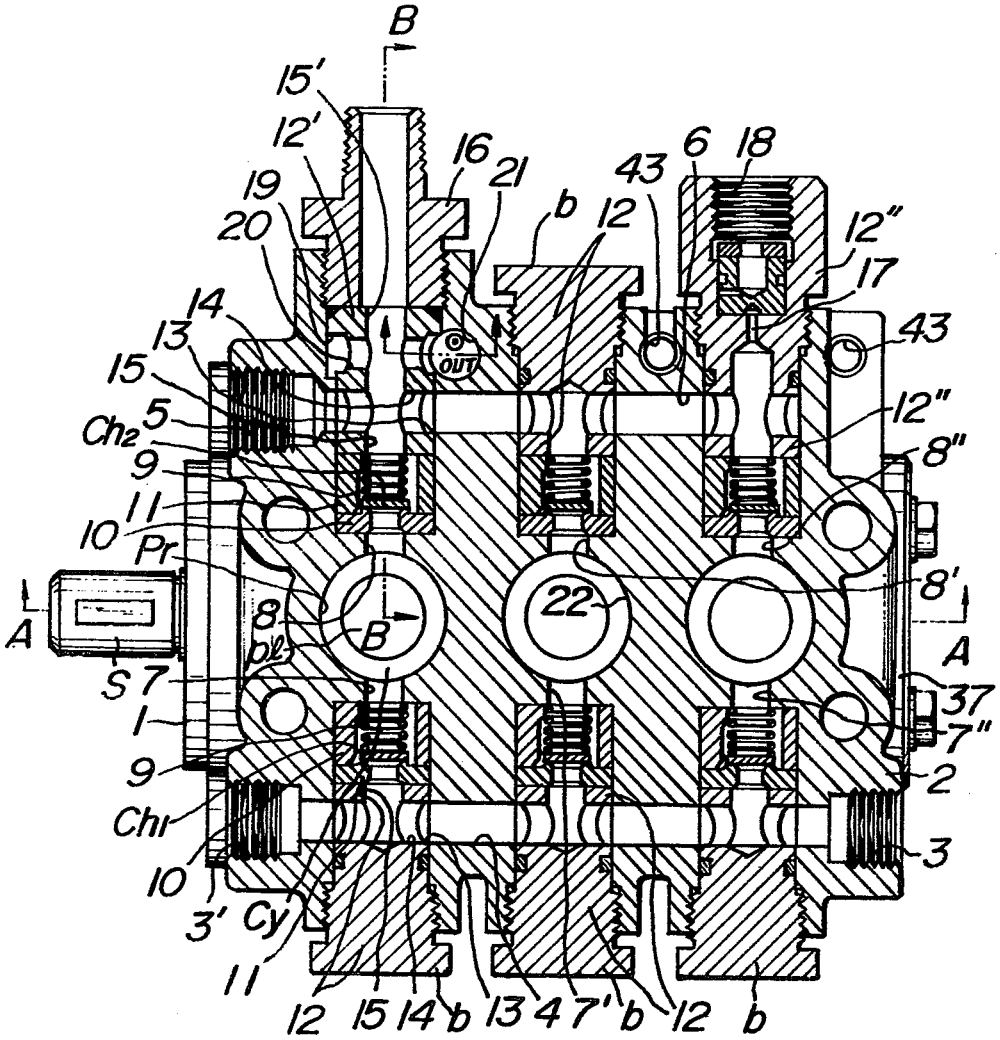
FIG. 5 is a longitudinal sectional view of a casing cover of a plunger pump shown in FIG. 1 showing suction and discharge passages.

As shown in FIGS. 1 and 5, a box-shaped pump casing 1 is closed by a casing cover 2 which is provided at its lower side portion with an inlet port 3 or 3' connected to the suction pipe i and an elongate hole 4 communicated with the inlet port 3 or 3' and for forming a suction passage. The casing cover 2 is provided at its upper side portion with a tapped hole 5 into which is fitted the pressure regulator *r* and an elongate hole 6 communicated with the tapped hole 5 and forming a discharge passage. The suction and discharge passages 4, 6 are arranged on opposite sides of the cam shaft S and in parallel therewith. In addition, these suction and discharge passages 4, 6 are communicated with stepped holes 7, 7' 7'' and 8, 8', 8'' formed in a direction perpendicular thereto and opened into a pump chamber P*r*. Each the large diameter holes 7, 8; 7', 8'; 7'', 8'' is provided with a suction check valve $Ch_1$ and a discharge check valve $Ch_2$.

In the present embodiment, each the check-valves $Ch_1$, $Ch_2$ is mounted through a spacer 10 and a washer ring 11 in the casing cover 2 by means of a plug 12. Each check valve $Ch_1$, $Ch_2$ is urged against the washer ring 11 by a compression spring 9 provided in the spacer 10. Each of the lower and upper center plugs 12 is composed of a blind plug *b* provided with a circumferential groove 13 communicated with the suction passage 4 or the discharge passage 6, an axial hole 14 opened at the base of the circumferential groove 13 and an axial hole 15 facing the center hole of the washer ring 11 or the spacer 10. The axial hole 15 provided for each the upper side plugs 12', 12'' is not made blind.

The upper side plug 12′ is provided at that end portion which is opposed to the check valve $Ch_1$ with a hole 15′. The plug 12′ is held in its position by a nipple 16 threadedly engaged with the casing cover 2. To the nipple 16 is secured the first accumulator $a_1$.

The another upper side plug 12′ is provided at its center with a tapped hole 18 which is communicated with a throttle 17 to the discharge passage 6. With the tapped hole 18 is threadedly engaged the pressure gauge 9.

In the present embodiment, the upper side plug 12′ is provided at its upper portion with another circumferential groove 19 and another axial hole 20 opened at the base of the circumferential groove 19. The circumferential groove 19 is communicated with the axial hole 15. The casing cover 2 is provided with a discharge opening 21 extending in a direction of tangent touching the circumferential groove 19 and communicated therewith.

Figure 6:
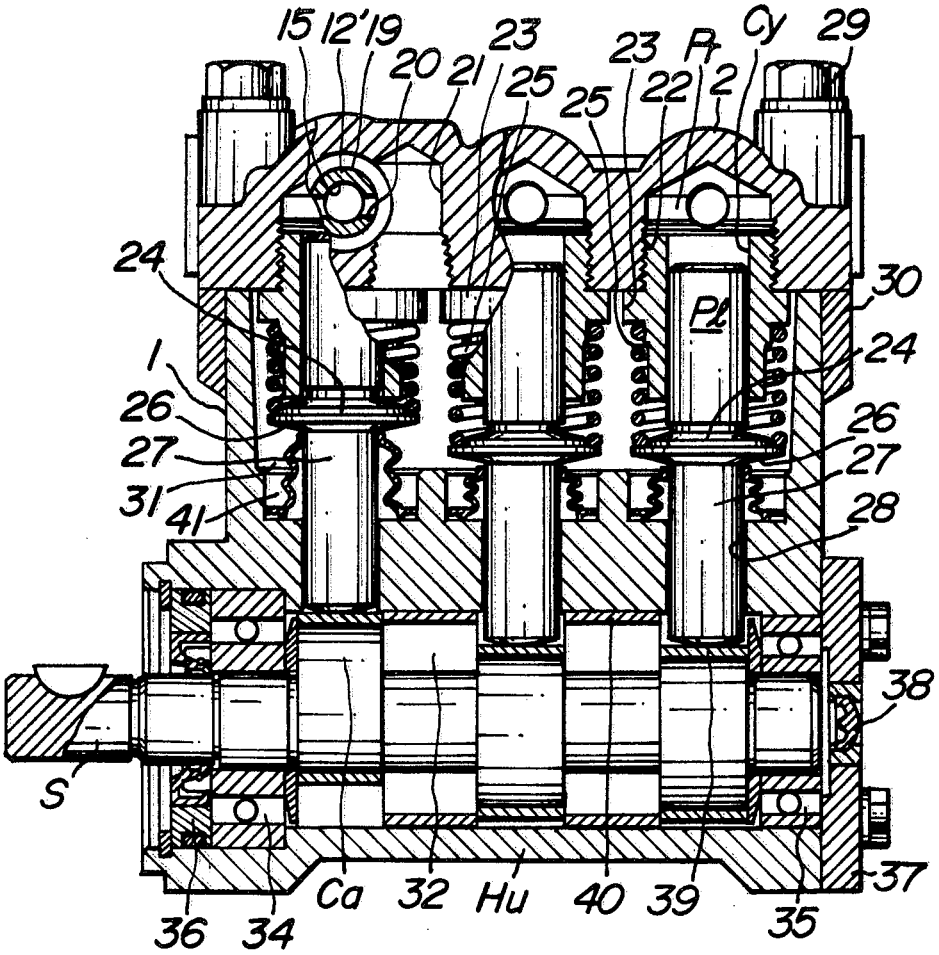
FIG. 6 is a sectional view taken along lines A—A and J—J of FIG. 5.

As shown in FIG. 6, the casing cover 2 is provided at its inner side located in the pump chamber P*r* with three tapped holes 22 with each of which is threadedly engaged the cylinder C*y*. The cylinder C*y* is provided at its intermediate outer surface with a flange 23 which is tightly clamped with the inner surface of the casing cover 2.

In the cylinder C*y* is slidably mounted the plunger P*l* which is provided at its lower end with a flange 24. Between the flanges 23, 24 is arranged a compression spring 25 for urging the plunger P*l* downwardly.

In accordance with the invention, a lower end surface 26 of the flange 24 is made spherical in shape and against this spherical end surface 26 of the flange 24 is abutted the upper end of a push rod 27. The casing 1 is provided with three guide holes 28 in each of which is slidably mounted the push rod 27.

The casing cover 2 is provided at its inner periphery with a boss 30 which is fitted around the casing 1. The casing cover 2 is detachably fastened to the casing 1 by means of bolts 29 as shown in FIGS. 1 and 6. The casing 1 is provided at its upper portion with an upper cavity 31 whose base portion is formed with three parallel holes which constitute the above mentioned guide holes 28.

The casing 1 is provided at its lower portion with a cam housing H*u* which defines a lower cavity 32 therein. Each the push rods 27 slidably mounted in the guide hole 28 is downwardly projected into the lower cavity 32 and always brought into contact with the outer periphery of one of the cams C*a* secured to the cam shaft S by means of the action of the compression spring 25.

The cam housing H*u* is provided at its both ends with roller bearings 34, 35 which serve to rotatably journal the cam shaft S in the casing 1. The cam housing H*u* is hermetically closed by means of an oil seal 36 and an end cover 37 which is provided with an oil level gauge 38.

As shown in FIG. 6, between the cam C*a* and the push rod 27 is inserted a journal ring 39 which is rotatable around the outer periphery of the cam C*a*.

It is preferable to arrange a spacer ring 40 between two adjacent journal rings 39, 39.

Figure 7:
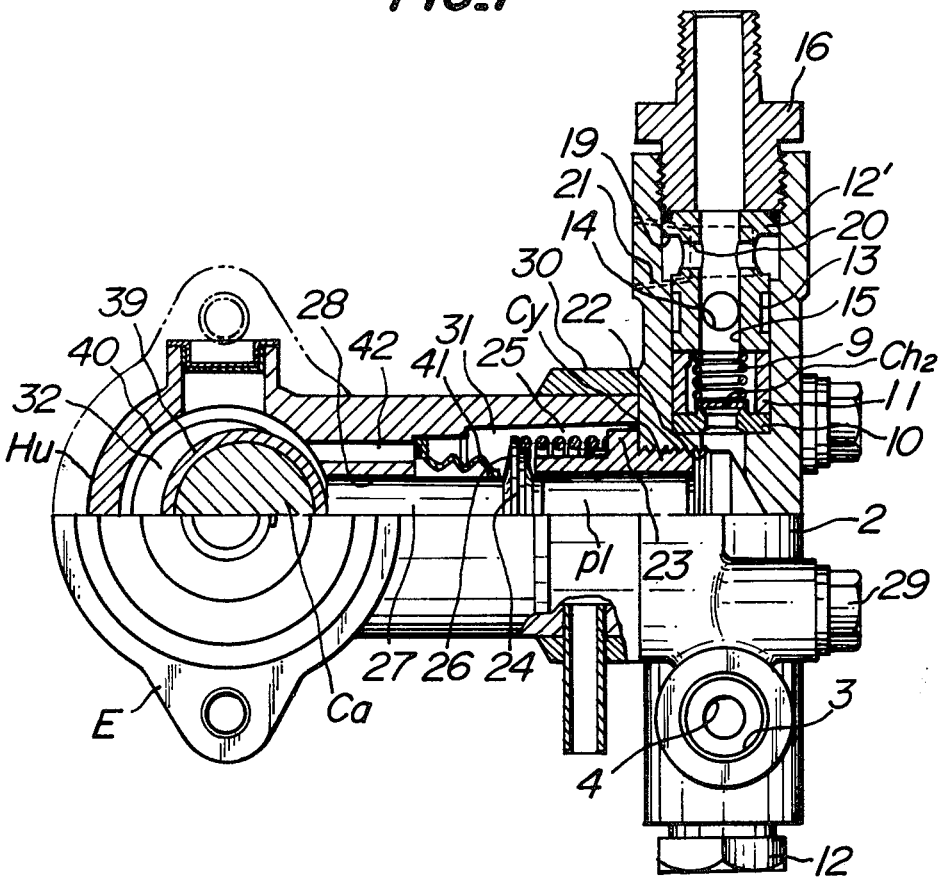
FIG. 7 is a side elevational view partly in section of FIG. 1, showing also a section taken along line B—B of FIG. 5.

In FIG. 6, reference numeral 41 designates bellows for sealing lubricating oil fed to the push rod 27, and 42 (FIG. 7) an oil groove formed in the cam housing H*u* and for guiding the lubricating oil into the bellows 41.

As shown in FIGS. 1 and 5, the casing cover 2 is provided at its upper portion with a pair of tapped holes 43, 43 arranged on opposite sides of the plug 12″ to be fitted with the pressure gauge *g*. With the tapped holes 43, 43 are threadedly engaged bolts 44 (FIG. 3) so as to secure a valve box enclosing the control valve j to the casing cover 2. In addition, as shown in FIGS. 2 and 3, the valve box enclosing the control valve *j* is arranged adjacent to a valve box enclosing the main valve *v* which is fastened to the former valve box by means of bolts 45.

It is preferable to use an electromagnetic valve as the main valve *v*. As shown in FIG. 2, an inlet 46 of the main valve *v* is connected through the connection pipe m to the discharge opening 21 of the casing cover 2, while an outlet 47 of the main valve *v* is connected through a throttle $t_1$ to an inlet passage 48 of the control valve *j*.

As shown in FIG. 3, the inlet passage 48 of the control valve *j* is communicated with a branch pipe 49 to which is connected the second accumulator $a_2$.

As shown in FIG. 2, the inlet passage 48 of the control valve *j* is communicated with a valve hole 50 fitted around a valve spool 51 (FIG. 3) which is operated by means of a cam 52 (FIG. 4) operatively connected to the loom and rotating a lever 53. The lever 53 is adapted to open and close an outlet hole 55 (FIG. 3) communicated through the circumferential groove 54 with the valve hole 50.

The outlet hole 55 is connected through a throttle $t_2$ to the water jet pipe *d*.

In this way, the water jet circuit shown in FIG. 4 is closed. The water jet circuit is capable of effecting the picking operation for flying a weft with water jet into warp openings during weaving operation of the water jet loom.

As stated hereinbefore, the reciprocating plunger pump according to the invention has a number of advantages. In the first place, in assembling a pump casing no special care is required for centering a pushing direction of a plunger with a cylinder, so that only fastening measure by bolts may be used for assembling the pump casing. As a result, it is possible to eliminate objectionable influence of the plunger for exerting side pressure upon the cylinder. Secondly, the use of fastening measure by bolts ensures a simple and easy assembling and disassembling operation of the pump casing. Third, the use of a pump casing and a casing cover with a cylinder and a plunger together with a water jet circuit incorporated therein makes it possible to make the pump casing, cylinder and plunger simple in construction and highly durable without necessitating any considerably large mechanical strength. Fourth, it is possible to provide a small type motor, so that a combination of the pump and a water jet device can be made small in size, light in weight and highly efficient in operation. Fifth, the use of simplified pump is capable of feeding back drain from mechanical valves to a pump drain chamber so as to add these drains with each other thereby omitting one drain hose. Finally, the use of a casing cover enclosing the jet water control device directly mounted thereon provides a compact device for emitting water jet under a high pressure, so that a composite device composed of the self-aligning reciprocating plunger pump and such water jet device can be installed in a significantly small space.

The invention is not limited to the water jet device, but may be applied to any other devices for feeding various kinds of liquid under a high pressure.

What is claimed is:

1. A combination of a reciprocating plunger pump and a water jet discharge device comprising:

a fluid inlet passage and a fluid outlet passage, a main valve, a control valve, a jet pipe, a plurality of cylinder-plunger-push rod-cam assemblies, each of said assemblies comprising a push rod adapted to reciprocate in response to movement of a camming member, a cylinder provided with an abutment and communicating with said inlet and outlet passages, a plunger adapted to reciprocate in said cylinder and being provided at its lower end with a flange having an arcuately shaped base portion, and a spring provided between said flange and said abutment on said cylinder for urging said arcuately shaped base portion of said flange against said push rod, a first fluid passage coupling said fluid outlet passage to the input of said main valve, a second fluid passage coupling the output of said main valve to an input of said control valve, a third fluid passage coupling the output of said control valve to said jet pipe, a casing for housing said fluid inlet passage, said fluid outlet passage, and said plurality of assemblies, and a casing cover detachably fastened to said casing, said main valve and said control valve being attached to said casing cover and communicating with said first, second and third fluid passages.

* * * * *